US008225932B2

(12) United States Patent
Burattini

(10) Patent No.: US 8,225,932 B2
(45) **Date of Patent: *Jul. 24, 2012**

(54) BREAK-OPEN SINGLE-DOSE SEALED PACKAGE

(75) Inventor: Christian Burattini, San Giovanni in Persiceto (IT)

(73) Assignee: Diapack Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/812,207

(22) PCT Filed: Sep. 23, 2008

(86) PCT No.: PCT/IB2008/002474

§ 371 (c)(1),
(2), (4) Date: Jan. 3, 2011

(87) PCT Pub. No.: WO2009/040629

PCT Pub. Date: Apr. 2, 2009

(65) Prior Publication Data

US 2011/0100859 A1 May 5, 2011

(30) Foreign Application Priority Data

Sep. 24, 2007 (IT) ..... BO2007A0643
Dec. 12, 2007 (IT) ..... BO2007A0815

(51) Int. Cl.
*B65D 73/00* (2006.01)
*B65D 47/10* (2006.01)
*B65D 17/00* (2006.01)

(52) U.S. Cl. ..... 206/469; 222/541.6; 229/237; 383/202

(58) Field of Classification Search ..... 206/469, 206/484–484.2; 222/92, 107, 541.6; 229/4.5, 229/200, 237; 383/202
See application file for complete search history.

(56) References Cited

U.S. PATENT DOCUMENTS

| | | | | |
|---|---|---|---|---|
| 2,215,705 | A * | 9/1940 | Lenz | 229/237 |
| 3,075,684 | A * | 1/1963 | Rothmann | 229/237 |
| 3,472,368 | A * | 10/1969 | Hellstrom | 206/469 |
| 3,632,461 | A | 1/1972 | Gayner et al. | |
| 4,236,652 | A * | 12/1980 | Beguhn | 229/237 |
| 4,762,230 | A * | 8/1988 | Croce | 206/469 |

(Continued)

FOREIGN PATENT DOCUMENTS

EP 0597446 5/1994

OTHER PUBLICATIONS

PCT International Search Resort and Written Opinion dated Jun. 24, 2009.

*Primary Examiner* — Bryon Gehman
(74) *Attorney, Agent, or Firm* — McCarter & English, LLP

(57) ABSTRACT

A break-open single-dose sealed package having: a first sheet of semi-rigid plastic material; a second sheet of flexible plastic material set on top of and welded to the first sheet of semi-rigid plastic material to define a sealed pocket that contains a dose of a product; and an incision made in the first sheet of semi-rigid plastic material for guiding controlled breaking of the first sheet along the incision so as to bring about formation, through the first sheet, of an opening for exit of the product; the incision has along its own length a variable depth in order to determine a progressive breaking of the first sheet along the incision.

15 Claims, 8 Drawing Sheets

U.S. PATENT DOCUMENTS 4,982,845 A 1/1991 Prascak et al.
5,395,298 A * 3/1995 Moesmann ..... 383/202
6,041,930 A 3/2000 Cockburn
6,945,391 B2 * 9/2005 Moodie ..... 222/107
7,506,762 B2 * 3/2009 Nelson et al. ..... 206/484.1
2003/0089625 A1 5/2003 Moodie
2005/0178086 A1 8/2005 Bakken

* cited by examiner

BREAK-OPEN SINGLE-DOSE SEALED PACKAGE

TECHNICAL SECTOR

The present invention relates to a break-open single-dose sealed package.

PRIOR ART

Traditionally, a single-dose sealed package is formed by a welded sachet or bag, which defines inside it a sealed pocket for containing a dose of a liquid product (for example, an alimentary sauce, such as ketchup, or a liquid detergent) or creamy product (for example, an alimentary sauce, such as mayonnaise, or a body cream). The sachet or bag is opened by tearing, and for this purpose has a small incision to facilitate said tearing.

However, it is very difficult to obtain tear-open sachets or bags that are at the same time simple to open (i.e., ones that can be opened by applying a small force) and sufficiently robust as to prevent any accidental opening (which is particularly harmful in the light of the considerable capacity for dirtying of the products contained in said sachets or bags). Said problem is particularly felt in the case of sachets or bags for detergent products (such as soap, shower or bath foam, shampoo), which are generally opened by the user with his or her hands wet and hence with a reduced gripping capacity. In addition, said tear-open sachets or bags are far from hygienic, in so far as, once the sachet or bag has been torn, the product always tends to come into contact with the outer surface of the sachet or bag in the proximity of the tear (obviously, said problem is important only for foodstuff products).

To solve the drawbacks described above, a different type of package has been proposed having a break opening instead of a tear opening. An example of a break-open single-dose sealed package is disclosed in the U.S. Pat. No. 6,041,930B1, which describes a package formed by a sheet of semi-rigid plastic material and by a sheet of flexible plastic material set on top of one another and welded together to define a sealed pocket that contains a dose of the product. The sheet of semi-rigid plastic material has at the centre a straight incision that guides a controlled breaking of the sheet of semi-rigid plastic material. In use, to open the package a user simply has to grip the package with his or her fingers and folding the package until the sheet of semi-rigid plastic material breaks along the incision. When the sheet of semi-rigid plastic material breaks along the incision, the product can be made to come out of the package in a simple and hygienic way in so far as, when the product comes out, it does not come into contact with the outer surface of the package.

However, in a break-open single-dose sealed package such as the one described in the U.S. Pat. No. 6,041,930B1, the product comes out very fast without the possibility of regulating the flow of the product, particularly when the product is liquid (i.e., it has a lower density). Said drawback is basically due to the fact that breaking of the sheet of semi-rigid plastic material occurs instantaneously almost throughout the incision thus bringing about formation of an opening of considerable dimensions.

In an attempt to solve the problem described above, i.e., to render exit of the product more controllable, it has been proposed to make a V-shaped incision as described in the U.S. Pat. No. 6,945,391B2. In this way, breaking of the sheet of semi-rigid plastic material should occur initially only in the central part of the incision (i.e., in a point corresponding to the vertex of the V) and only subsequently should breaking extend along the remaining part of the incision. Consequently, the user ought to be able to generate a break limited to the central part alone of the incision and hence bring about formation of an opening of reduced dimensions. However, various experimental tests have highlighted the fact that also the solution proposed in the U.S. Pat. No. 6,945,391B2 not unable to solve effectively and efficiently the problem of rendering exit of the product controllable in a simple and intuitive way, in particular for a liquid product.

In addition, in the break-open single-dose sealed packages described above the break along the incision (i.e., the opening of the package with consequent exit of the product contained therein) may occur even accidentally during handling of the packages themselves.

DESCRIPTION OF THE INVENTION

The aim of the present invention is to provide a break-open single-dose sealed package, said package being free from the drawbacks described above and being, in particular, easy and inexpensive to produce.

According to the present invention, a break-open single-dose sealed package is provided according to what is recited in the annexed claims.

BRIEF DESCRIPTION OF THE DRAWINGS

The present invention will now be described with reference to the annexed drawings, which illustrate some non-limiting examples of embodiment thereof, in which.

PREFERRED EMBODIMENTS OF THE INVENTION

Figure 2:
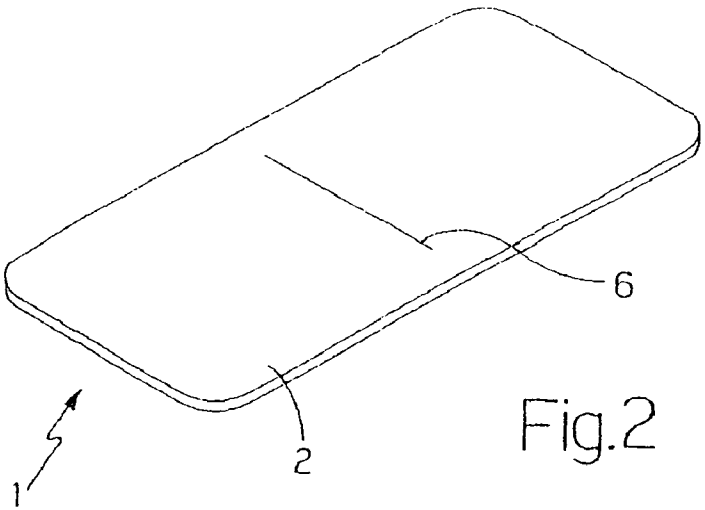
FIG. 2 is a perspective view from beneath of the package of FIG. 1.
Figure 1:
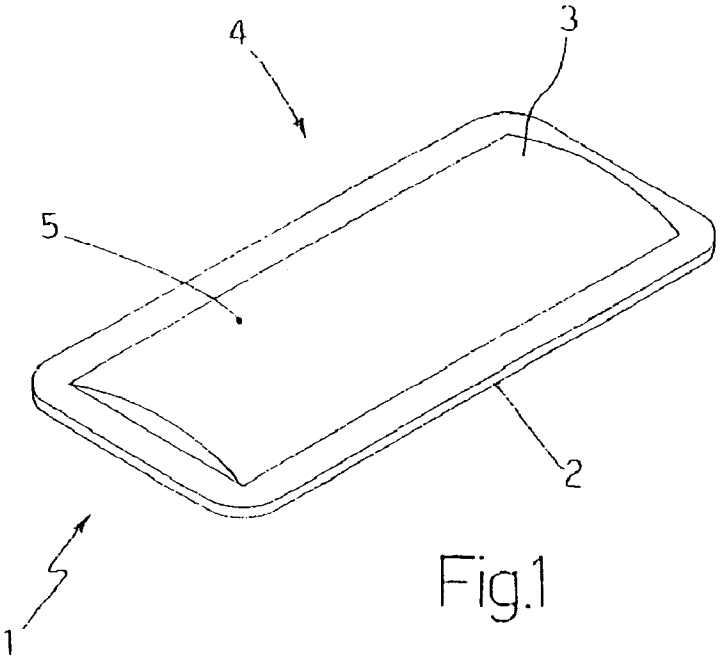
FIG. 1 is a perspective view from above of a break-open single-dose sealed package made in accordance with the present invention.

In FIGS. 1 and 2, the reference number 1 designates as a whole a break-open single-dose sealed package. The package 1 comprises a rectangular sheet 2 of semi-rigid plastic material and a sheet 3 of flexible plastic material, which is set on top of and welded to the sheet 2 of semi-rigid plastic material to define a sealed pocket 4 that contains a dose of a product 5 (liquid, cream, or powder).

The sheet 2 of semi-rigid plastic material has an incision 6 at the centre, which develops in a direction transverse to the sheet 2 of semi-rigid plastic material (i.e., parallel to a smaller side of the sheet 2 of semi-rigid plastic material) for guiding controlled breaking of the sheet 2 along the incision 6 so as to bring about formation through the sheet 2 of an opening for exit of the product 5. In other words, in use to open the package 1*a* user must simply grip the package 1 with his or her fingers and folding the package 1 until the sheet 2 of semi-rigid plastic material breaks along the incision 6. When the sheet 2 of semi-rigid plastic material breaks along the incision 6, the product 5 can be made to come out of the package 1 in a simple and hygienic way in so far as, when the product 5 comes out, it does not come into contact with the outer surface of the package 1 (i.e., of the sheet 2 of semi-rigid plastic material).

According to what is illustrated in FIGS. 3-8, the incision 6 has, along its own length, a variable depth in order to determine a progressive breaking of the sheet 2 of semi-rigid plastic material along the incision 6. In particular, the incision 6 has a maximum depth in a central portion of the incision 6. In other words, breaking of the sheet 2 of semi-rigid plastic material along the incision 6 is always progressive, i.e., proportional to the degree of folding of the package 1. In this way, when the package 1 is folded by a relatively small amount, the sheet 2 of semi-rigid plastic material breaks only in the central portion of the incision 6 and, when the degree of folding of the package 1 is increased, breaking of the sheet 2 of semi-rigid plastic material extends also to the outer portions of the incision 6.

Figure 3:
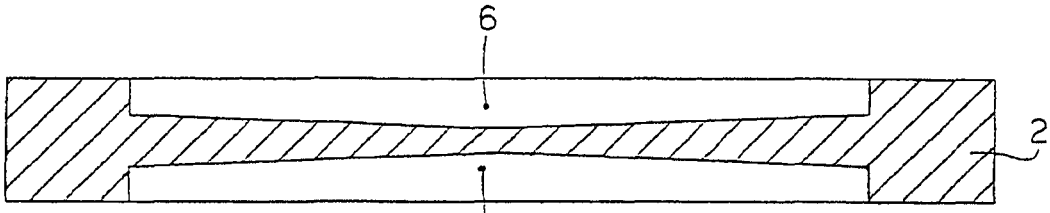
FIG. 3 is a schematic cross-sectional view in an area corresponding to a transverse incision of the package of FIG. 1.
Figure 7:
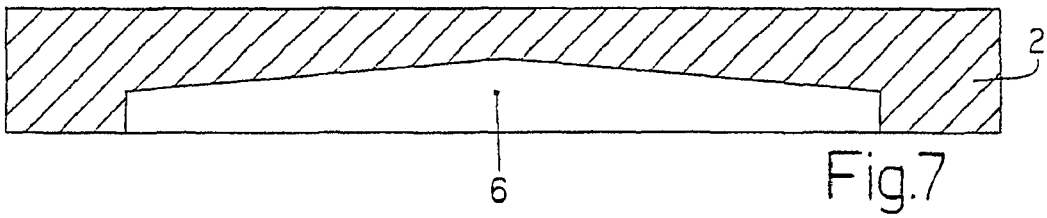

According to what is illustrated in FIGS. 3 and 7, the cross section of the incision 6 is V-shaped.

Figure 4:
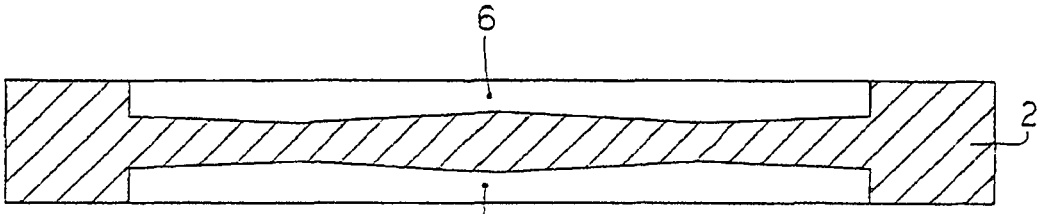
FIGS. 4-8 are schematic cross-sectional views in an area corresponding to a transverse incision of variant embodiments of the package of FIG. 1.
Figure 8:
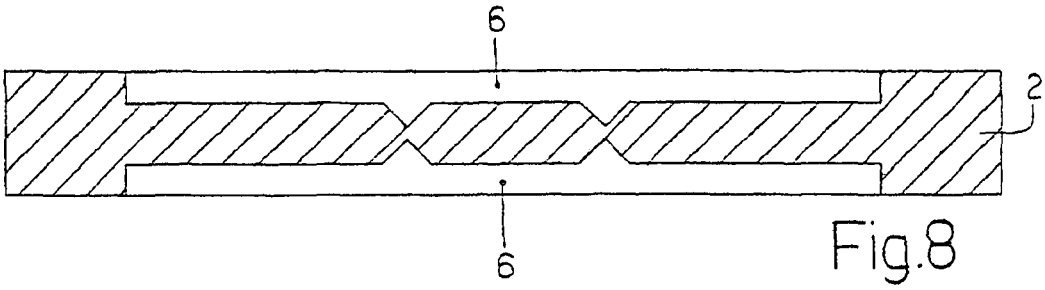

According to what is illustrated in FIGS. 4 and 8, the cross section of the incision 6 is W-shaped.

Figure 5:
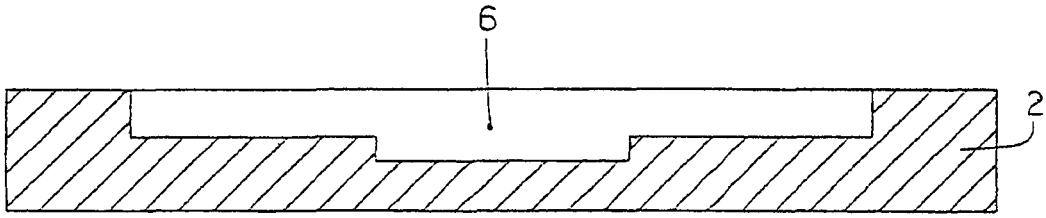
Figure 6:
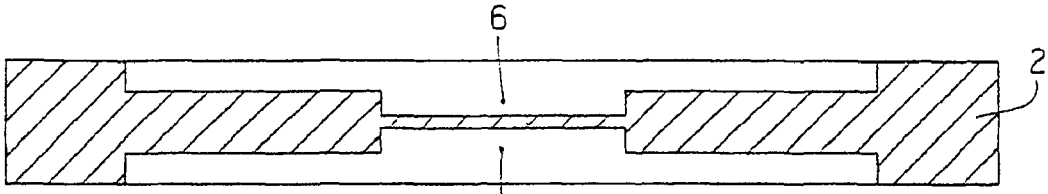

According to what is illustrated in FIGS. 5 and 6, the incision 6 has a first constant depth in outer portions and a second depth greater than the first depth and constant in the central portion.

According to what is illustrated in FIGS. 3, 4, 6 and 8, the incision 6 is made in both sides of the sheet 2 of semi-rigid plastic material. Alternatively, according to what is illustrated in FIGS. 5 and 7 the incision 6 is made on just one side of the sheet 2 of semi-rigid plastic material.

According to what is illustrated in FIGS. 2-8, the incision 6 does not involve the entire width of the sheet 2 of semi-rigid plastic material, but only a central portion of the sheet 2 of semi-rigid plastic material leaving intact (i.e., without any incision 6) two side portions of the sheet 2 of semi-rigid plastic material set symmetrically on opposite sides of the incision 6. Preferably, each side portion of the sheet 2 of semi-rigid plastic material has a width comprised between 3 and 7 mm and normally approximately 5 mm.

Said characteristic (i.e., the fact that the incision 6 only involves a central portion of the sheet 2 of semi-rigid plastic material) proves very important in so far as it enables the sheet 2 of semi-rigid plastic material to maintain a sufficient elasticity even after progressive breaking of the sheet 2 of semi-rigid plastic material along the incision 6. In other words, progressive breaking of the sheet 2 of semi-rigid plastic material along the incision 6 does not bring about complete transverse fracture of the sheet 2 of semi-rigid plastic material in so far as the side portions of the sheet 2 of semi-rigid plastic material set symmetrically on opposite sides of the incision 6 remain intact and hence are able to bestow a sufficient elasticity upon the sheet 2 of semi-rigid plastic material. Thanks to the fact that even after progressive breaking of the sheet 2 of semi-rigid plastic material along the incision 6 the sheet 2 of semi-rigid plastic material maintains a sufficient elasticity, exit of the product 5 proves far more easily controllable and can be simply interrupted (for example, to deliver the product 5 in a number of goes and not all at one). In fact, by releasing the package 1 after folding it in order to determine progressive breaking of the sheet 2 of semi-rigid plastic material along the incision 6, the package 1 by elastic return is restored to a plane or almost plane configuration, in which the fracture of the sheet 2 of semi-rigid plastic material along the incision 6 is substantially closed. Obviously, by folding the package 1 again, the fracture of the sheet 2 of semi-rigid plastic material along the incision 6 is immediately reopened to enable delivery of a further amount of product 5.

Figure 9:
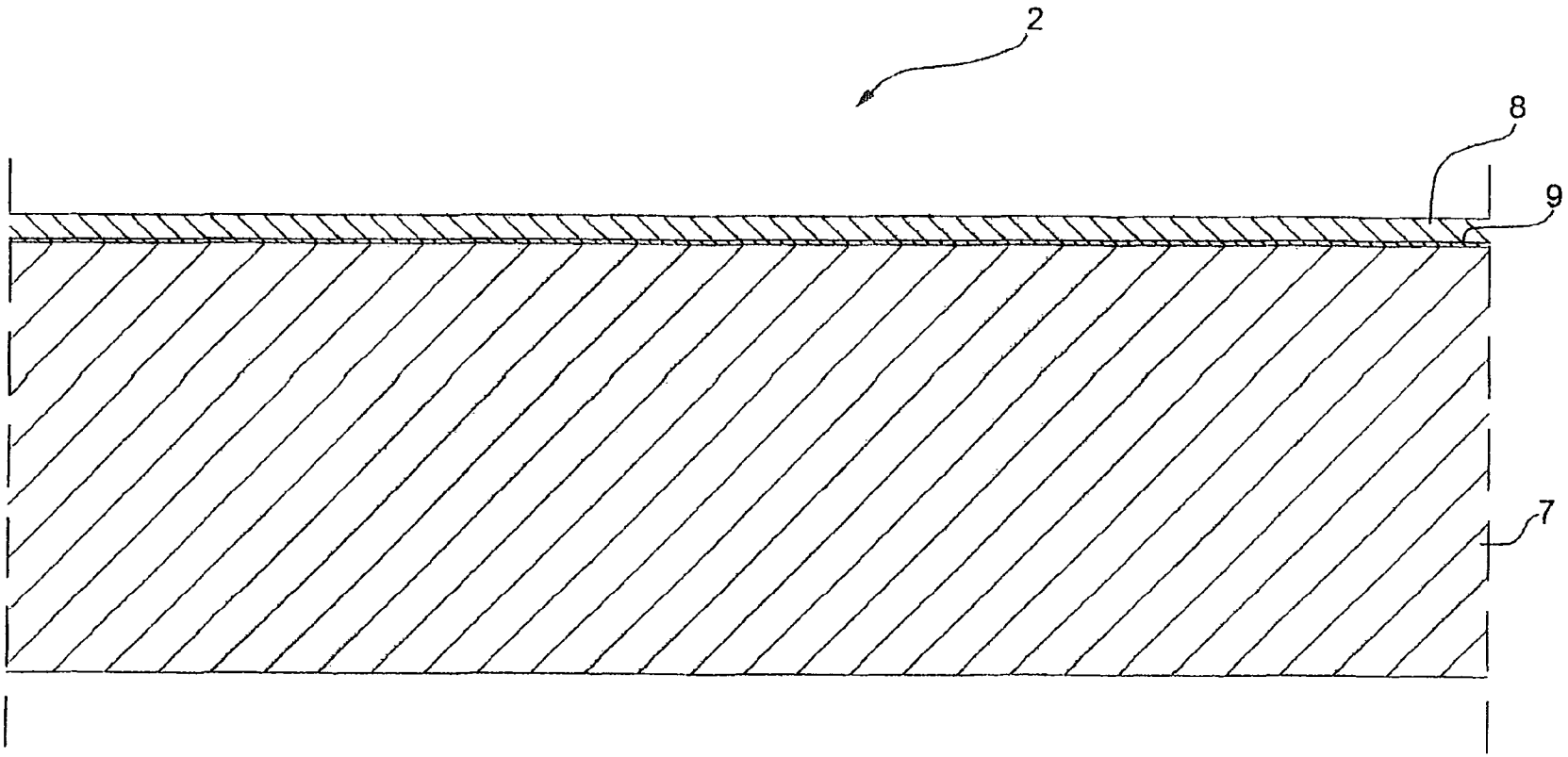
FIG. 9 is a schematic cross-sectional view of a sheet of semi-rigid plastic material of the package of FIG. 1.

According to a preferred, though non-binding, embodiment illustrated in FIG. 9, the sheet 2 of semi-rigid plastic material is constituted by a laminate made up of a load-bearing layer 7 set externally and a heat-sealable layer 8 set internally (i.e., in contact with the sheet 3 of flexible plastic material). Between the load-bearing layer 7 and the heat-sealable layer 8 there can be provided a further isolating or barrier layer 9 having the purpose of guaranteeing impermeability to air and/or light.

According to a preferred embodiment:

- the load-bearing layer 7 of the sheet 2 of semi-rigid plastic material is made of one of the following materials: polystyrene (PS), polyvinyl chloride (PVC), acrylonitrile-butadiene-styrene (ABS), amorphous polyethylene terephthalate (APET), or else polypropylene (PP) and has a thickness of between 400 μm and 500 μm, and preferably 450 μm;
- the heat-sealable layer 8 of the sheet 2 of semi-rigid plastic material is made of one of the following materials: polyethylene (PE) or polypropylene (PP) and has a thickness of between 20 μm and 30 μm, and preferably 25 μm;
- between the load-bearing layer 7 and the heat-sealable layer 8 a further barrier layer 9 is provided, which has the purpose of guaranteeing impermeability to air and/or light and is made, for example, of "Evoh" and has a thickness of between 3 μm and 10 μm, and preferably 5 μm.

In the case described above, the sheet 2 of semi-rigid plastic material is preferably made up of a white load-bearing layer 7 of polystyrene (PS) having a thickness of 450 μm (±10%), a barrier layer 9 of "Evoh" having a thickness of 5 μm (±10%) and a heat-sealable layer 8 of polyethylene (PE) having a thickness of 25 μm (±10%). With this combination, the sheet 2 of semi-rigid plastic material has the characteristics appearing in the table below.

| Characteristic | Method of analysis | Value |
|---|---|---|
| Total weight | Mbp 1001 | 497.3 ± 7% |
| Yield | / | 2.0 ± 7% |
| Oxygen transmission rate | ASTM D 3985-81 | <1.3 |
| Water-vapour transmission rate | ASTM F 1249-90 | <15.0 |
| Ultimate elongation (MD) (%) | UNI-EN-ISO 527-3 | 70 ± 10% |
| Ultimate elongation (TD) (%) | UNI-EN-ISO 527-3 | 55 ± 10% |
| Tensile stress (MD) (MPa) | UNI-EN-ISO 527-3 | 22 ± 2 |
| Tensile stress (TD) (MPa) | UNI-EN-ISO 527-3 | 20 ± 2 |

More in general, the load-bearing layer 7 of the sheet 2 of semi-rigid plastic material can be made of one of the following materials: polystyrene (PS), polyvinyl chloride (PVC), acrylonitrile-butadiene-styrene (ABS), amorphous polyethylene terephthalate (APET), or else polypropylene (PP) and has a thickness of between 300 μm and 700 μm. Instead, the heat-sealable layer 8 of the sheet 2 of semi-rigid plastic material can be made of one of the following materials: polyethylene (PE) or polypropylene (PP) and has a thickness of between 20 μm and 50 μm.

Appearing in Table 1 below are the possible combinations of materials and thicknesses for obtaining the sheet 2 of semi-rigid plastic material.

TABLE 1

| Sheet 2 of semi-rigid plastic material | |
|---|---|
| Type of laminate | Thicknesses (μm) |
| PS - PE | PS 300 ÷ 700 PE 20 ÷ 50 |
| PS - PP | PS 300 ÷ 700 PP 20 ÷ 50 |
| PVC - PE | PVC 300 ÷ 700 PE 20 ÷ 50 |
| ABS - PE | ABS 300 ÷ 700 PE 20 ÷ 50 |
| APET - PE | APET 300 ÷ 700 PE 20 ÷ 50 |
| PP - PE | PP 300 ÷ 700 PE 20 ÷ 50 |

An alternative embodiment envisages that the load-bearing layer 7 of the sheet 2 of semi-rigid plastic material will be made of polystyrene (PS) with a thickness of 450 μm and that the heat-sealable layer 8 of the sheet 2 of semi-rigid plastic material will be made of polyethylene (PE) with a thickness of 35 μm. In this case, the sheet 2 of semi-rigid plastic material has a thickness of approximately 485 μm, a typical weight per unit surface of approximately 500 g/m$^2$, a typical ultimate strength of approximately 16 N/mm$^2$, and a typical elastic modulus of approximately 2200 N/mm$^2$.

According to a preferred, though non-binding, embodiment, the sheet 3 of flexible plastic material is constituted by a laminate made up two, three, or four layers.

The layers of the sheet 3 of flexible plastic material can comprise: polyethylene terephthalate (PET), polyethylene (PE), polyethylene with barrier layer 9 (BARRIER PE), metallized polyethylene terephthalate (MPET), aluminium (ALU), oriented polypropylene (OPP), oriented polyamide (OPA).

Appearing in Table 2 below are the possible combinations of materials and thicknesses to obtain the sheet 3 of flexible plastic material.

TABLE 2

| Sheet 3 of flexible plastic material | |
|---|---|
| Type of laminate | Thicknesses (μm) |
| PET - PE | PET 12 ÷ 30/PE 20 ÷ 150 |
| PET - BARRIER PE | PET 12 ÷ 30/PE 30 ÷ 150 |
| PET BARRIER - PE | PET 12 ÷ 30/PE 20 ÷ 150 |
| PET - MPET - PE | PET 12 ÷ 30/MPET 12 ÷ 23/PE 20 ÷ 150 |
| PET - ALU - PE | PET 12 ÷ 30/ALU 6 ÷ 30/PE 20 ÷ 150 |
| OPP - ALU - PE | OPP 15 ÷ 3/ALU 6 ÷ 30/PE 20 ÷ 150 |
| OPA - ALU - PE | OPA 15 ÷ 30/ALU 6 ÷ 30/PE 20 ÷ 150 |
| PET - ALU - PET - PE | PET 12 ÷ 30/ALU 6 ÷ 30/PE 20 ÷ 150 |
| PET - PET BARRIER - PE | PET 12 ÷ 30/PET BARR 12 ÷ 30/PE 20 ÷ 150 |
| PET - ALU - OPA - PE | PET 12 ÷ 30/OPA 15 ÷ 30/ALU 6 ÷ 30/PE 20 ÷ 150 |

According to a preferred, though non-binding, embodiment, in a point corresponding to the maximum depth of the incision 6, the sheet 2 of semi-rigid plastic material has a thickness of between 75 and 150 μm and, for example, 100 μm. In addition, the difference between the maximum depth of the incision 6 and the minimum depth of the incision 6 is between 50 and 150 μm and is, for example, 100 μm.

In the embodiments illustrated in the attached figures, the incision 6 is rectilinear and is set parallel to the smaller side of the sheet 2 of semi-rigid plastic material. According to different embodiments (not illustrated), the incision 6 can have other conformations; for example, it can be curved (e.g., in the form of an arc of a circumference or an arc of an ellipse), V-shaped, U-shaped, or else L-shaped. In addition, according to further embodiments (not illustrated either), the incision 6 can be set slanting, i.e., oblique with respect to the sides of the sheet 2 of semi-rigid plastic material.

Figure 10:
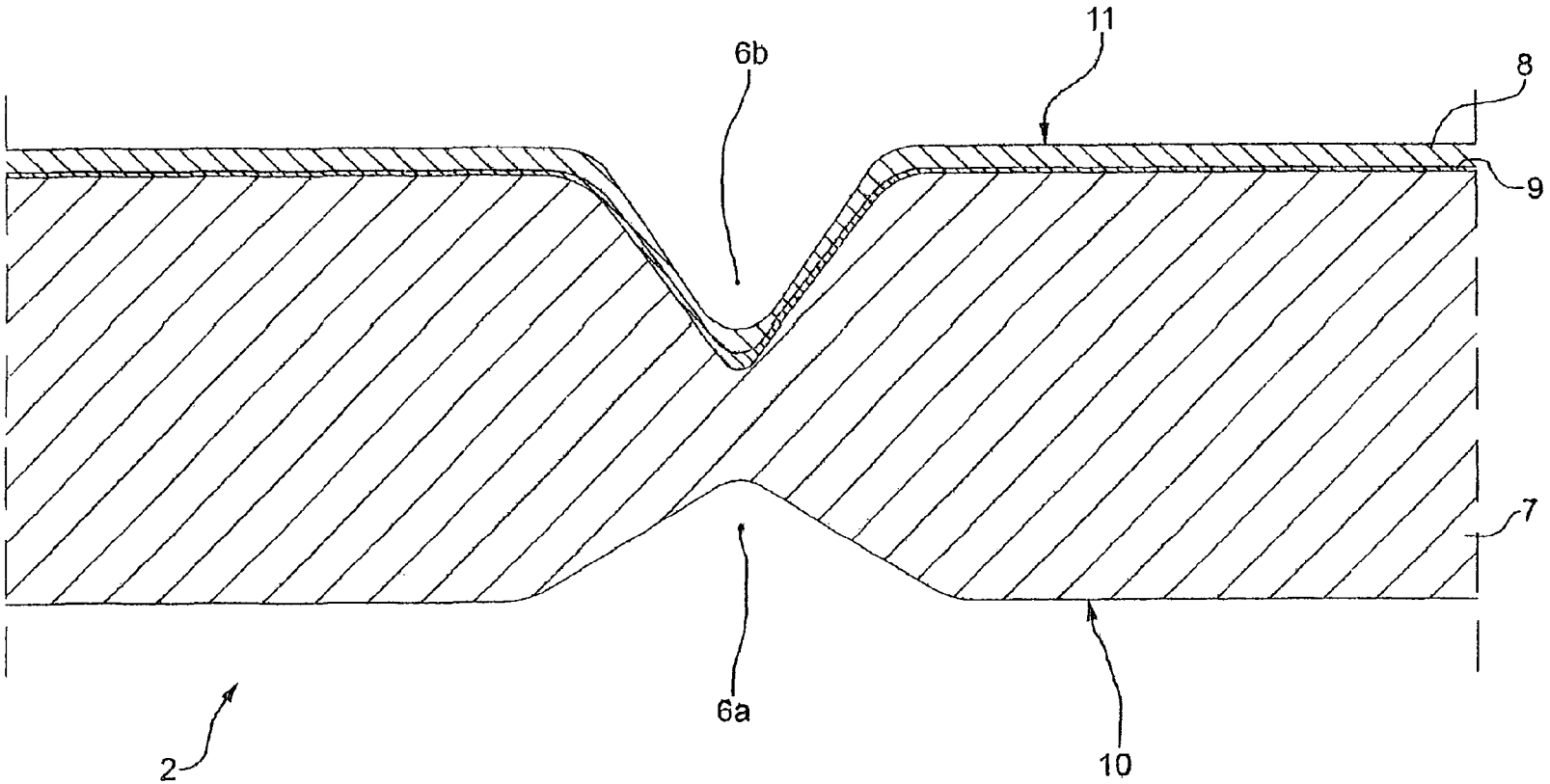
FIG. 10 is a schematic view in longitudinal section in an area corresponding to a transverse incision of a sheet of semi-rigid plastic material of the package of FIG. 1.

According to what is illustrated in FIG. 10, the incision 6 is made on both sides of the sheet 2 of semi-rigid plastic material. In other words, the incision 6 is constituted by a groove 6*a* made in an outer wall 10 of the sheet 2 of semi-rigid plastic material (i.e., on the opposite side with respect to the pocket 4) and by a groove 6*b* made in an inner wall 11 of the sheet 2 of semi-rigid plastic material (i.e., on the same side of the pocket 4).

The groove 6*a* made in the outer wall 10 of the sheet 2 of semi-rigid plastic material is V-shaped and is made so as to bring about local deformation of the sheet 2 of semi-rigid plastic material and in particular the load-bearing layer 7 of the sheet 2 of semi-rigid plastic material.

The groove 6*b* made in the inner wall 11 of the sheet 2 of semi-rigid plastic material is V-shaped and is made so as to bring about local deformation of the sheet 2 of semi-rigid plastic material and in particular all three layers, i.e., the load-bearing layer 7, the heat-sealable layer 8, and the barrier layer 9, of the sheet 2 of semi-rigid plastic material. It should be noted that, in a point corresponding to the groove 6*b* made in the inner wall 11 of the sheet 2 of semi-rigid plastic material, the heat-sealable layer 8, and above all the barrier layer 9, of the sheet 2 of semi-rigid plastic material undergo local deformation (even in an irregular way), but are not torn, i.e., they remain intact. Owing to the fact that the barrier layer 9 of the sheet 2 of semi-rigid plastic material remains substantially intact also in the area corresponding to the groove 6*b* made in the inner wall 11 of the sheet 2 of semi-rigid plastic material, it is possible to ensure perfect isolation of the pocket 4, which is hence suited for containing even perishable products and/or products with controlled bacterial charge such as foodstuffs, medicines, or cosmetics. Obviously, during break-opening of the package 1 obtained by bending the package 1 back on, it is necessary to break along the incision 6 all three layers, i.e., the load-bearing layer 7, the heat-sealable layer 8, and the barrier layer 9, of the sheet 2 of semi-rigid plastic material.

As has been said previously, the incision 6 has along its own length a variable depth to bring about a progressive breaking of the sheet 2 of semi-rigid plastic material along the incision 6. In particular, the incision 6 has a maximum depth in a central portion of the incision 6. Preferably, each groove 6*a* and 6*b* has along its own length a variable depth. Alternatively, one groove 6*a* or 6*b* could present along its own length a variable depth, whilst the other groove 6*b* or 6*a* could present along its own length a constant depth.

Figure 12:
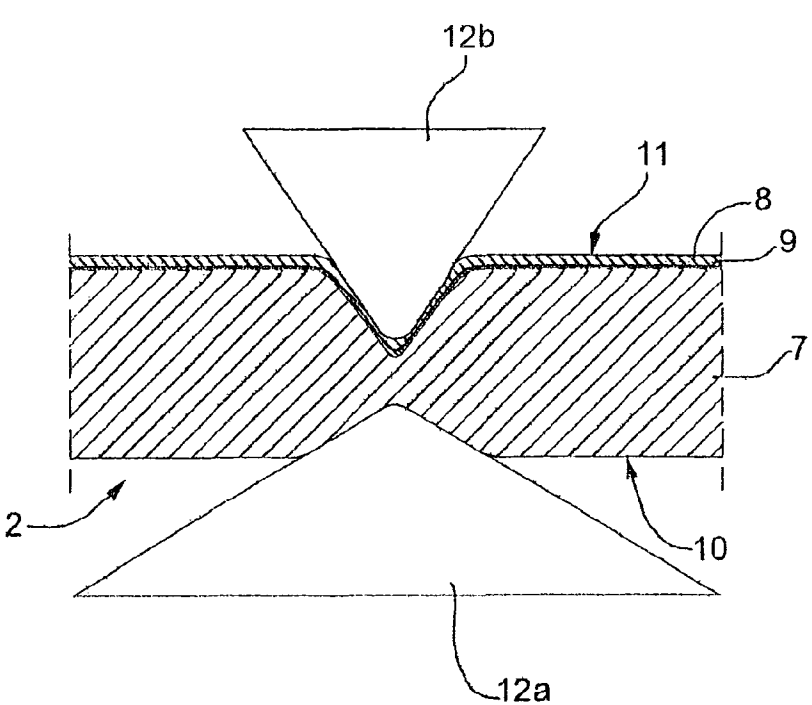
FIGS. 11 and 12 illustrate two steps of processing of the sheet of semi-rigid plastic material of FIG. 9 during formation of the transverse incision.
Figure 11:
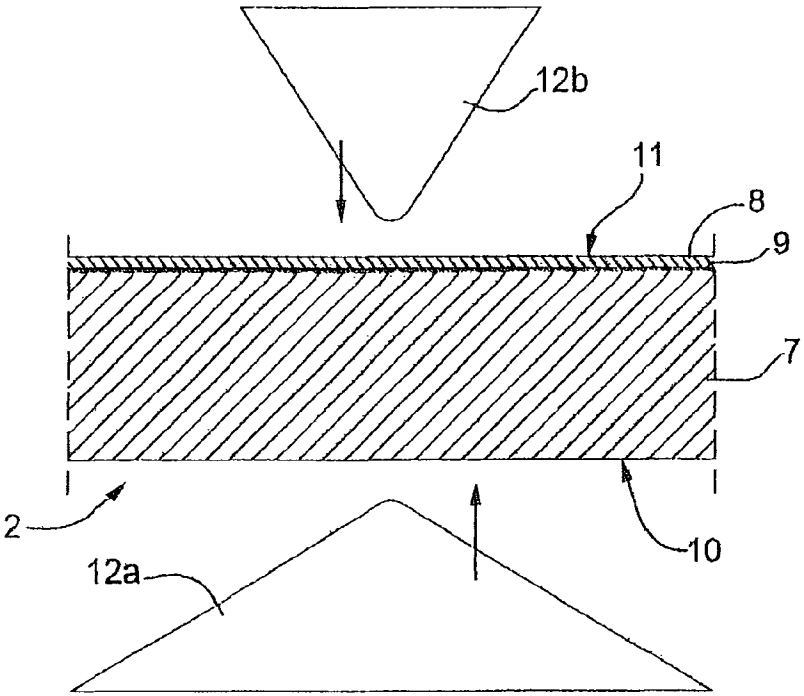

As illustrated in FIGS. 11 and 12, to obtain the incision 6 two appropriately shaped blades 12 are used, which are pressed simultaneously and on opposite sides against the sheet 2 of semi-rigid plastic material so as to grip the sheet 2 of semi-rigid plastic material between them. Obviously, a blade 12*a* that makes the groove 6*a* in the outer wall 10 of the sheet 2 of semi-rigid plastic material can be sharper in order to penetrate the load-bearing layer 7 more easily. Instead, a blade 12*b* that makes the groove 6*b* in the inner wall 11 of the sheet 2 of semi-rigid plastic material needs to be less sharp (or even without any sharp edge and hence with a rounded tip) so as to bring about local deformation of the load-bearing layer 7, the heat-sealable layer 8, and the barrier layer 9 of the sheet 2 of semi-rigid plastic material without cutting the heat-sealable layer 8 and above all the barrier layer 9. In other words, the blade 12*b* must be shaped so as to be able to bring about local deformation of the load-bearing layer 7, the heat-sealable layer 8, and the barrier layer 9 of the sheet 2 of semi-rigid plastic material without cutting the heat-sealable layer 8 and above all the barrier layer 9.

According to the embodiment illustrated in FIG. 10, the groove 6*a* made in the outer wall 10 of the sheet 2 of semi-rigid plastic material is aligned with the groove 6*b* made in the inner wall 11 of the sheet 2 of semi-rigid plastic material; said embodiment is suitable for dispensing pastry products 5, i.e., ones with higher density.

Figure 13:
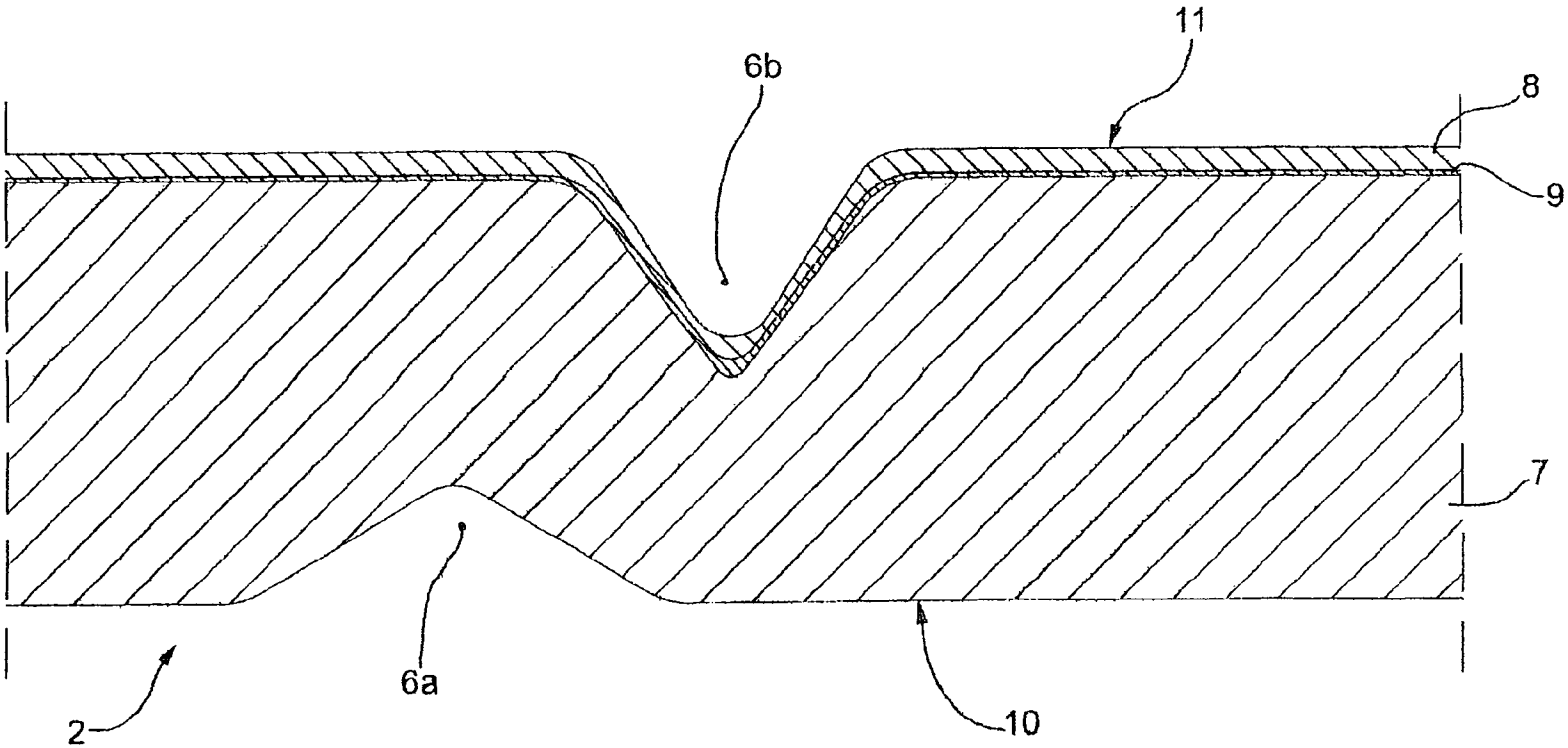
FIGS. 13 and 14 are two schematic views in longitudinal section in an area corresponding to a transverse incision of respective variant embodiments of the sheet of semi-rigid plastic material of FIG. 10.
Figure 14:
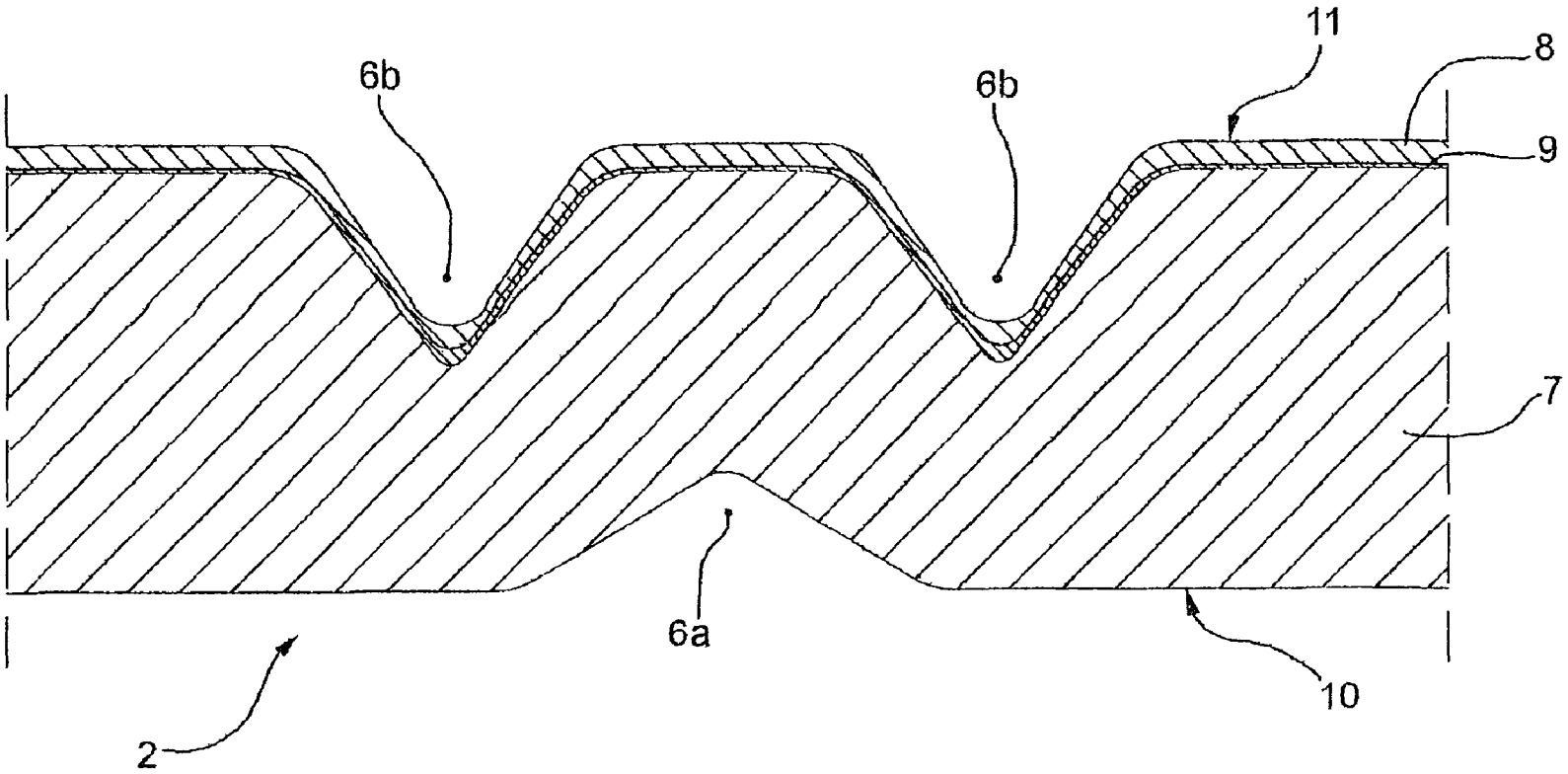

Instead, according to the embodiment illustrated in FIG. 13, the groove 6*a* made in the outer wall 10 of the sheet 2 of semi-rigid plastic material is longitudinally misaligned with respect to the groove 6*b* made in the inner wall 11 of the sheet 2 of semi-rigid plastic material. Said embodiment is suitable for dispensing oily or liquid products 5, i.e., ones with lower density. In fact, said embodiment enables limitation of the rate of exit of the product 5, thus preventing any undesirable squirting or splashing of the product 5. A variant of the embodiment illustrated in FIG. 13 is illustrated in FIG. 14 and envisages the provision of two grooves 6*b*, which are made in the inner wall 11 of the sheet 2 of semi-rigid plastic material and are set on opposite sides of the groove 6*a* made in the outer wall 10 of the sheet 2 of semi-rigid plastic material.

Preferably, the longitudinal staggering between the groove 6*a* made in the outer wall 10 of the sheet 2 of semi-rigid plastic material and the groove 6*b* (or each groove 6*b*) made in the inner wall 11 of the sheet 2 of semi-rigid plastic material is in general comprised between 200 μm and 500 μm and is preferably in the region of 300 μm.

In the embodiment illustrated in FIGS. 1 and 2, the package 1 has a rectangular shape. Obviously, for aesthetic reasons, the package 1 could have any other shape: round, elliptical, bottle-shaped, rhomboidal, pentagonal, hexagonal, triangular, square, bone-shaped. Obviously, the outer surface of the sheet 2 of semi-rigid plastic material and/or of the sheet 3 of flexible plastic material can be printed on both so as to bear information on the product 5 and so as to provide an greater aesthetic decoration.

The package 1 described above presents numerous advantages, in so far as it is simple and inexpensive to produce and at the same time enables simple and intuitive control of exit of the product 5. In particular, exit of the product 5 is controlled simply in so far as, on account of the differentiated thickness of the incision 6, breaking of the sheet 2 of semi-rigid plastic material occurs initially only in the central part of the incision 6, and only subsequently does it extend along the remaining part of the incision 6. In this way, it is simple and intuitive to create a limited break of the sheet 2 of semi-rigid plastic material and hence bring about formation of an opening of small dimensions through which the product 5 can come out slowly. Obviously, if a fast exit of the product is desired, it is sufficient to increase the size of the break made in the sheet 2 of semi-rigid plastic material, i.e., increase the size of the opening. The increase in the size of the break of the sheet 2 of semi-rigid plastic material is obtained very simply by increasing folding of the package 1.

In other words, in the package 1 described above breaking of the sheet 2 of semi-rigid plastic material along the incision 6 is always progressive, i.e., proportional to the degree of folding of the package 1. In this way, it is simple and intuitive to regulate exit of the product 5 by varying the degree of folding of the package 1.

In addition, in the package 1 described above breaking of the sheet 2 of semi-rigid plastic material along the incision 6 occurs only if the package 1 is folded in a transverse direction (i.e., parallel to the incision 6) through a considerable angle (typically at least)70-90°. Consequently, any accidental breaking of the sheet 2 of semi-rigid plastic material along the incision 6 during handling of the package 1 is highly unlikely.

The invention claimed is:

1. A break-open single-dose sealed package (1), comprising:

a first sheet (2) of semi-rigid plastic material, which is constituted by a laminate made up of a load-bearing layer (7), a heat-sealable layer (8), and an isolating or barrier layer (9) set between the load-bearing layer (7) and the heat-sealable layer (8);

a second sheet (3) of flexible plastic material set on top of and welded to the first sheet (2) of semi-rigid plastic material for defining a sealed pocket (4) that contains a dose of a product (5); and an incision (6) provided in the first sheet (2) of semi-rigid plastic material for guiding controlled breaking of the first sheet (2) along the incision (6) so as to bring about formation through the first sheet (2) of an opening for exit of the product (5);

wherein the incision (6) is provided on both sides of the first sheet (2) of semi-rigid plastic material and constitutes a first groove (6*a*) made in an outer wall (10) of the first sheet (2) of semi-rigid plastic material and a second groove (6*b*) made in a second inner wall (11) of the first sheet (2) of semi-rigid plastic material; and wherein the second groove (6*b*) is made so as to bring about local deformation of all three layers (7, 8, 9) of the first sheet (2) of semi-rigid plastic material to maintain the barrier layer intact.

2. The single-dose sealed package (1) according to claim 1, wherein the load-bearing layer (7) of the first sheet (2) of semi-rigid plastic material is made of one of the following materials: polystyrene (PS), polyvinyl chloride (PVC), acrylonitrile-butadiene-styrene (ABS), amorphous polyethylene terephthalate (APET), and polypropylene (PP).

3. The single-dose sealed package (1) according to claim 2, wherein the load-bearing layer (7) of the first sheet (2) of semi-rigid plastic material has a thickness of between 300 μm and 700 μm.

4. The single-dose sealed package (1) according to claim 1, wherein the heat-sealable layer (8) of the first sheet (2) of semi-rigid plastic material is made of one of the following materials: polyethylene (PE) or polypropylene (PP).

5. The single-dose sealed package (1) according to claim 4, wherein the heat-sealable layer (8) of the first sheet (2) of semi-rigid plastic material has a thickness of between 20 μm and 50 μm.

6. The single-dose sealed package (1) according to claim 1, wherein the load-bearing layer (7) of the first sheet (2) of semi-rigid plastic material is made of polystyrene (PS) with a thickness of 450 μm, and the heat-sealable layer (8) of the first sheet (2) of semi-rigid plastic material is made of polyethylene (PE) with a thickness of 35 μm.

7. The single-dose sealed package (1) according to claim 6, in the first sheet (2) of semi-rigid plastic material has a total thickness of approximately 485 μm, a typical weight of approximately 500 g/m$^2$, a typical ultimate strength of approximately 16 N/mm$^2$, and a typical elastic modulus of approximately 2200 N/mm$^2$.

8. The single-dose sealed package (1) according to claim 1, wherein single-dose sealed package (1) the incision (6) has along its own length a variable depth in order to determine a progressive breaking of the first sheet (2) along the incision (6).

9. The single-dose sealed package (1) according to claim 8, wherein the incision (6) involves only a central portion of the first sheet (2) leaving intact two side portions of the first sheet (2) set symmetrically on opposite sides of the incision (6).

10. The single-dose sealed package (1) according to claim 9, wherein each side portion of the first sheet (2) has a width comprised between 3 and 7 mm.

11. A break-open single-dose sealed package (1), comprising:

a first sheet (2) of semi-rigid plastic material;

a second sheet (3) of flexible plastic material set on top of and welded to the first sheet (2) of semi-rigid plastic material for defining a sealed pocket (4) that contains a dose of a product (5); and an incision (6) provided in the first sheet (2) of semi-rigid plastic material for guiding controlled breaking of the first sheet (2) along the incision (6) so as to bring about formation through the first sheet (2) of an opening for exit of the product (5);

wherein the incision (6) has along its own length a variable depth in order to determine a progressive breaking of the first sheet (2) along the incision (6) and involves only a central portion of the first sheet (2) leaving intact two side portions of the first sheet (2), each side portion set symmetrically on at opposite ends of the incision (6).

12. The single-dose sealed package (1) according to claim 11, wherein each side portion of the first sheet (2) has a width comprised between 3 and 7 mm.

13. The single-dose sealed package (1) according to claim 11, wherein the first sheet (2) of semi-rigid plastic material is constituted by a laminate made up of a load-bearing layer (7), a heat-sealable layer (8), and an isolating or barrier layer (9) set between the load-bearing layer (7) and the heat-sealable layer (8); and wherein the incision (6) is provided on both sides of the first sheet (2) of semi-rigid plastic material and is constituted by a first groove (6*a*) provided in an outer wall (10) of the first sheet (2) of semi-rigid plastic material and a second groove (6*b*) provided in a second inner wall (11) of the first sheet (2) of semi-rigid plastic material; the second groove (6*b*) being made so as to bring about local bending deformation of all three layers (7, 8, 9) of the first sheet (2) of semi-rigid plastic material to maintain the barrier layer intact.

14. The single-dose sealed package (1) according to claim 11, wherein the incision (6) is of a maximum depth along a central portion of the length of the incision (6).

15. The single-dose sealed package (1) according to claim 11, wherein the incision (6) is made on both sides of the first sheet (2) of semi-rigid plastic material and comprises a first groove (6*a*) provided in an outer wall (10) of the first sheet (2) of semi-rigid plastic material and a second groove (6*b*) provided in a second inner wall (11) of the first sheet (2) of semi-rigid plastic material.

* * * * *